US006849290B2

(12) United States Patent
Mäkinen et al.

(10) Patent No.: US 6,849,290 B2
(45) Date of Patent: Feb. 1, 2005

(54) METHOD FOR CONTROLLING DEFLECTION AND/OR POSITION OF A DEFLECTION-COMPENSATED DOCTOR BEAM

(75) Inventors: Jukka Mäkinen, Kerava (FI); Jukka Koskinen, Järvenpää (FI); Timo Kiiha, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/380,364

(22) PCT Filed: Sep. 17, 2001

(86) PCT No.: PCT/FI01/00805

§ 371 (c)(1),
(2), (4) Date: Apr. 7, 2003

(87) PCT Pub. No.: WO02/22950

PCT Pub. Date: Mar. 21, 2002

(65) Prior Publication Data

US 2003/0161956 A1 Aug. 28, 2003

(30) Foreign Application Priority Data

Sep. 18, 2000 (FI) ..... 20002056

(51) Int. Cl.[7] ..... B05D 3/12
(52) U.S. Cl. ..... 427/8; 427/356; 427/444
(58) Field of Search ..... 427/8, 356, 444; 118/712, 123, 126

(56) References Cited

U.S. PATENT DOCUMENTS 4,907,528 A * 3/1990 Sollinger ..... 118/121
5,005,515 A * 4/1991 Sollinger ..... 118/100
5,269,846 A * 12/1993 Eskelinen et al. ..... 118/100

FOREIGN PATENT DOCUMENTS

GB 2222968 A 3/1990
GB 2251562 A 7/1992

* cited by examiner

*Primary Examiner*—Katherine Bareford
(74) *Attorney, Agent, or Firm*—Cohen, Pontani, Lieberman & Pavane

(57) ABSTRACT

A method for controlling the deflection and/or position of a deflection-compensated doctor blade support beam relative to a web. The movement range of the doctor blade support beam is divided into radial control sectors so that the working directions of compensation elements in the support beam essentially form interface limits of the radial control sectors. When the support beam is to be moved, a set point is selected toward which a reference point of the support beam should move. The specific control sector is then determined within which the set point is located and this control sector becomes the active control sector. Deflection of the doctor blade support beam employs these two compensation elements so that one is used for controlling the deflection in the x-axis direction of the coordinate system, while the other is used for controlling the deflection in the y-axis direction of the coordinate system.

13 Claims, 2 Drawing Sheets

METHOD FOR CONTROLLING DEFLECTION AND/OR POSITION OF A DEFLECTION-COMPENSATED DOCTOR BEAM

PRIORITY CLAIM

This is a national stage of PCT application No. PCT/FI01/00805, filed on Sep. 17, 2001. Priority is claimed on that application and on Application No. 20002056, filed in Finland, on Sep. 18, 2000.

BACKGROUND OF THE INVENTION

The invention relates to a method for controlling the deflection and/or position of a deflection-compensated doctor blade support beam.

This kind of method is used for controlling the deflection and/or position of a deflection-compensated doctor blade support beam relative to a web such as a paper or paperboard web.

Paper and similar web-like material are coated by applying to the moving web of the base material a layer of coating mix which is then spread into an even layer onto the web surface with the help of a doctor blade. In the coater, the web-like material to be coated passes through a gap formed between the doctor blade and a suitable backing member, conventionally a rotating roll. The blade doctors excess coating away from the web surface and levels the coating mix into an even layer on the web surface. In order to achieve a coat layer as even as possible, the linear force loading the doctor blade against the web should be sufficiently strong and constant over the entire cross-machine length of the blade to attain uniform spreading of the coating mix onto the web even at high web speeds.

For several reasons, the force loading the doctor blade against the material web does not stay exactly constant. During its machining, the doctor blade and its frame are fixed to the machining unit base with strong fixtures into a position simulating their operating position. Despite exact placement of the fixtures on the machining unit, defects will develop during the machining of the doctor blade and its frame causing an error to appear in the parallel alignment between the web surface and the doctor blade tip. As the doctor blade of the coater is pressed against the moving web, the blade is loaded with a linear force. However, due to the pivotal support of the doctor blade frame by bearings mounted at both ends thereof, the deflection induced by the linear load force becomes greater at the center of the blade than at the supported ends, whereby the blade runs closer to the web at its ends than at its middle portion. Since the linear force exerted by the blade onto the surface of the web or the backing roll is smaller in the middle of the blade than at its supported ends, the profile of the applied coat becomes uneven.

Calenders are today equipped with deflection-compensated rolls rotating about a load-bearing center shaft roll. Between the center shaft roll and the roll shell surrounding the same are adapted compensation elements whose shape can be controlled so as to keep the roll shell straight in a cylindrical shape. In U.S. Pat. No. 5,269,846 is disclosed a doctor blade support beam comprising a box-section frame, together with a holder of the doctor blade, and a support tube placed to the interior of the frame. The support tube is backed against the frame by means of three asymmetrically placed compensating elements that advantageously are pressurized hoses. The deflection of the doctor blade beam is compensated for by varying the volume of the compensating elements through pressure alterations in the elements. With the help of three compensating elements, the doctor blade position can be adjusted in desired direction in the cross-sectional planes of the doctor blade support beam. By virtue of the thus accomplished position shift, the deflection of the doctor blade can be compensated for up to an essentially perfect straightness. The compensating system is controlled with the help of a feedback control loop using data obtained from a direct measurement of beam deflection, or alternatively, from the surface profile of the coated web. The straightness of the beam is controlled on the basis of measurement data either automatically or manually.

In conventional control methods developed for a deflection-compensated doctor blade support beam, automatic control is accomplished by way of, e.g., first adjusting the center point of the support beam, or any other suitable reference point, to a desired position by changing the temperature of the thermal compensation circuit elements of the doctor blade support beam based on the desired direction toward which the center point of the support beam should move. Each thermal compensation circuit can move the position of the support beam center point and, thus, the beam deflection, in the working direction toward which the respective compensation circuit is adapted to effect. Herein, the term working direction must be understood as the direction of support beam movement under the effect of a temperature change induced in the thermal compensation circuit. The working directions of the thermal compensation circuits can be determined either by mechanical modeling computations or by effecting temperature changes in each thermal compensation circuit separately and then determining therefrom the magnitude and direction of the induced response.

A problem hampering this prior-art technique is that the control of the support beam response is slow. This is because a slightest control action requires a change in the temperature of the heat transfer circuit. As a result, the settling time of the control system defined, e.g., as the response time (within a preset tolerance) from the launch of a control command to the instant the desired blade position is attained becomes longer. Furthermore, if only two separate thermal compensation circuits are used, the deflection of the doctor blade support beam can be adjusted only in regard to one linear control line. Herein, it is possible that the control line is least optimal as compared to the desired direction of control.

SUMMARY OF THE INVENTION

It is an object of the present invention to provide a method for controlling the position of a deflection-compensated doctor blade support beam, the method featuring improved speed of control in the adjustment of the support beam into a desired position.

The goal of the invention is achieved by way of dividing the movement area of the support beam, that is, the area over which the reference point of the beam can be moved by the compensation elements, into control sectors so that the working-direction vectors of the compensation elements essentially define the radial limit vectors of the control sectors. Thus, the radial limit vectors of adjacent control sectors are oriented substantially orthogonal to the longitudinal axis of the support beam. Herein, a suitable reference point is selected for the doctor blade support beam, e.g., a point that is located at the interface of the control sector radial limits with the provision that the volumes of the compensation elements are substantially equal or, alternatively, the thicknesses of the compensation elements are substantially equal as measured in the working direction of each compensation element. After the choice of the reference point, the location of the reference point is maintained constant in regard to the frame of the doctor blade support beam, whereby the actual position of the support beam may be modeled computationally with the help of the reference point. For computations, a suitable coordinate system can be selected such as, e.g., an orthogonal coordinate system having its origin placed at the center axis of the support tube. When the support beam is desired to be moved, first a new set point is defined and then the goal is to move the reference point of the support beam to coincide with the set point. After the set point is defined, the control sector wherein the set point is situated is determined and the thus determined control sector is selected to be the active control sector. For the control operation, the system uses, e.g., such two compensation elements whose working direction vectors are oriented substantially in the same direction as the radial limit vectors of the active control sector. The control of the doctor blade support beam is carried out so that with the help of these two compensation elements that the deflection of the support beam is adjusted by controlling the support beam deflection and/or position by one compensation element in the x-axis direction of the selected coordinate system, while the other compensation element is used for controlling the support beam deflection and/or position in the y-axis direction of the selected coordinate system.

The invention offers significant benefits.

The novel control method makes it possible to control the deflection of the doctor blade support beam using only two compensation elements at a time. Moreover, the method permits mutually noninteracting control of the compensation elements used for position control (that is, either one of the compensation elements controls the beam position and/or deflection only in one direction), thus minimizing the position/deflection changes taking place in an undesired direction. As a result, the method offers faster deflection and/or position control of the doctor blade support beam than that provided by conventional control methods (such as an SISO control system circuit not offering the benefit of mutually decoupled control circuits). Also the stability of the control system is better. The novel control method also reduces the vibrations that occur when the doctor blade support beam is moved in the working direction of a compensation element. Moreover, the method minimizes non-minimum-phase behavior in a control circuit.

BRIEF DESCRIPTION OF THE DRAWINGS

In the following, the invention will be examined in greater detail with the help of exemplifying embodiments and making reference to the appended drawings in which.

DETAILED DESCRIPTION OF THE PRESENTLY PREFERRED EMBODIMENTS

Figure 1:
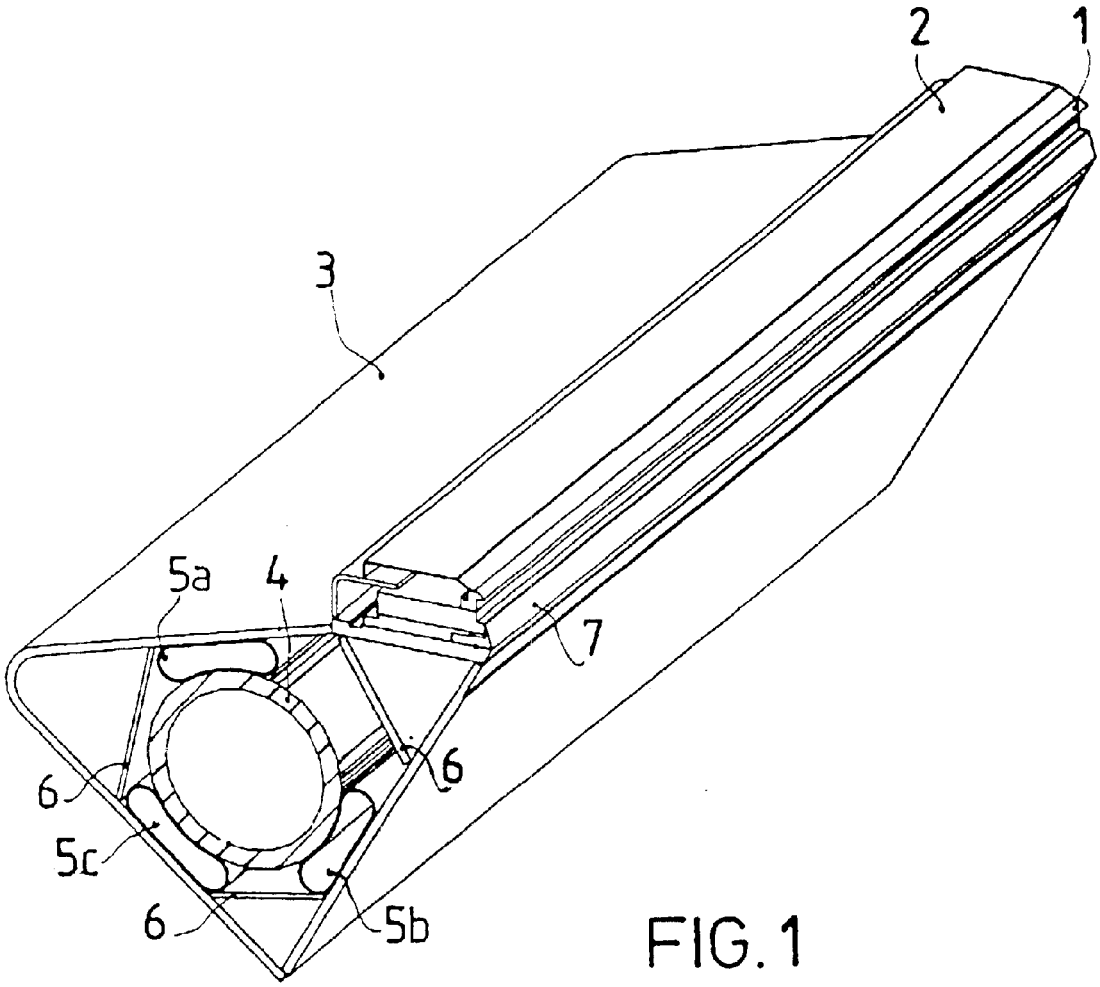
FIG. 1 shows a diagrammatic perspective view of a prior-art deflection compensated doctor blade support beam, wherein the deflection can be controlled by means of compensation elements.
Figure 2:
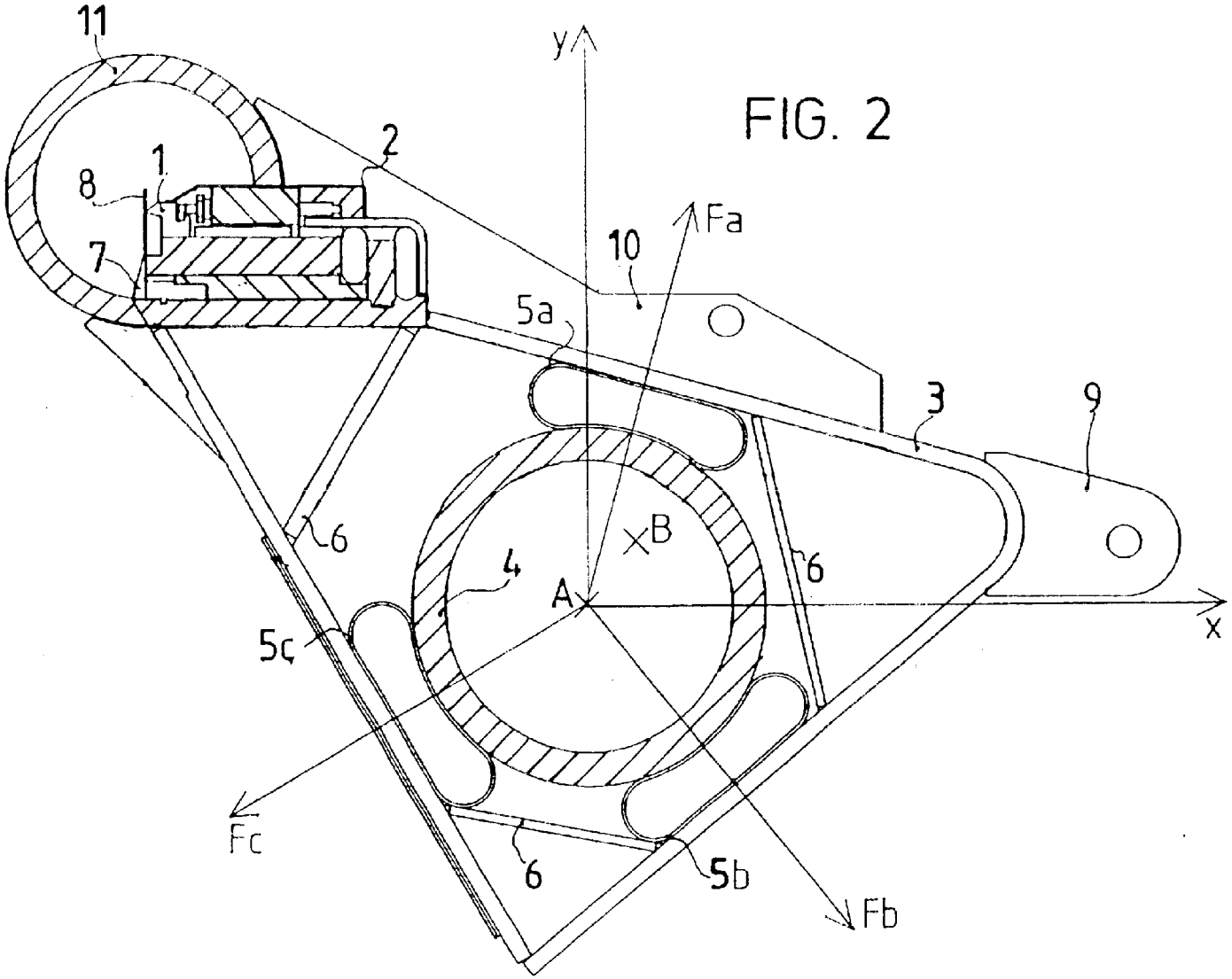
FIG. 2 shows a cross-sectional view of a prior-art deflection-compensated doctor blade support beam taken perpendicular to the longitudinal axis of the beam, whereby in the diagram are also denoted the working directions of the compensation elements, the coordinate axes of the selected coordinate system, the reference point chosen for the support beam and the selected set point.

As shown in FIGS. 1 and 2, the principal elements of a deflection-compensated doctor blade support beam comprise a triangular-shape support beam frame 3 incorporating stiffening walls 6 at the corners of the triangular box-section beam, a doctor blade holder 2 adapted to one corner of the triangular cross section, a support tube 4 and compensation elements 5. As shown in FIG. 2, to the front edge of the doctor blade holder 2 is mounted a holder member 7 of the doctor blade 8 and a loading member 1 thereof. The doctor blade 8 is omitted from FIG. 1. The doctor blade 8 is connected by its lower edge to the holder member 7 and the blade is loaded against the web to be coated by means of a loading member 1 displaced at a suitable distance from the tip of the blade 8. Inasmuch different types of doctor blade holders are well known in the art, and, further, since the structure of the doctor blade holder is irrelevant to the applications of the present invention, its detailed description has been omitted herein. The doctor blade support beam is mounted on its support block by means of a bearing 11 and support members 9 and 10. The support tube 4 is connected via articulated bearings to the ends of the frame 3. As these kinds of support arrangements are well known in the art, their further description is omitted herein.

The deflection compensation system described in the diagrams comprises a support tube 4 with three compensation elements 5 adapted thereabout in an unsymmetrical fashion. The compensation elements 5 are located about the round support tube 4 so that they are radially disposed at different distances from each other about the periphery of the support tube 4. This arrangement provides an unsymmetrical support system between the doctor blade support beam frame 3 and the support tube 4. One side of each compensation element 5 rests against the planar wall of the doctor blade support beam frame 3, while the other side folds about the round surface of the support tube 4. Advantageously, pressure hoses filled with pressurized fluid are used as the compensation elements 3.

Deflection compensation is accomplished by way of altering in a suitable manner the pressure of the liquid or gas contained in the pressure hoses 5*a*, 5*b* and 5*c*. Elevating the fluid pressure in one of the pressure hoses causes expansion of the hose, whereby the distance between the doctor blade support beam frame 3 and the support tube 4 in the direction of expansion increases. Such a mutual displacement in three different directions in the cross-sectional plane of the support beam may be accomplished by means of three pressure hoses 5, whereby the combined effect of these displacements can be utilized to compensate for any displacement in the cross-sectional plane of the doctor blade support beam. Herein, the control of the internal volume of the pressure hoses 5 is arranged so that, e.g., the volume of two of the pressure hoses 5 is simultaneously altered in suitable ratio relative to each other, whereby the desired compensating displacement is attained. The benefit of an unsymmetrical support system is that it makes easier to generate the required displacements inasmuch the generation of a single force component in a desired direction always requires two mutually different counterforce components. In a symmetrical system the counterforce components become equal and, if there is used an even number of the compensation elements, pairwise opposed forces will be imposed on the doctor blade support beam frame 3 and the support tube 4. Now, a simultaneous control of the above-mentioned fluid pressures gives in an easy fashion the desired displacement of the doctor blade support beam frame 3 relative to the support tube 4. The simplest technique of controlling the fluid pressure in the pressure hoses 5 and, thereby, the support beam displacements, is to use a feedback control loop complemented by the measurement of either the straightness and/or position of the doctor blade support beam by a suitable method or, alternatively, the coating layer profile of the coated web, whereby the straightness of the doctor blade 8 and the actual position and/or deflection of the doctor blade support beam can be determined from the deviations in the coating layer profile. For the function of the control algorithm, it is sufficient to know the directions toward which the support beam displacement under the actuation of each one of the compensation elements 5 occur, whereby it is possible through detecting the deflection of the doctor blade support beam either by direct sensing or, alternatively, from a coat weight profile measurement, to accomplish a desired compensating displacement through altering the fluid pressure in the compensation elements 5 with the help of a feedback control loop.

The fluid pressure in the pressure hoses 5 is controlled by means of a suitable fluidic pressure control circuit. In the present context, the term fluid must be understood to refer to a flowable substance including, e.g., liquids and gases, whose pressure can be elevated and lowered. Accordingly, it is possible to arrange the fluid pressure circuit of each one of the pressure hoses to operate in a conventional fashion so that the circuit attenuates oscillations in the fluid pressure. Such oscillations generally arise in the pressure circuit from the vibrations of the doctor blade supporting system and the doctor blade support beam during operation of the doctoring unit and also from external vibrations transmitted to the supporting system frame and further therefrom to the doctor blade support beam from other areas of the factory building and, particularly, from the vibrations of the backing roll. Herein, the attenuating fluid circuit, with the pressure hoses 5 connected thereto, operates as an effective fluidic damper reducing the vibrations of the doctor blade support beam.

In addition to the details described above, FIG. 2 also shows the working directions Fa, Fb and Fc of the compensation elements 5*a*, 5*b* and 5*c*, as well as the coordinate axes x and y of the selected coordinate system, the reference point A selected for the doctor blade support beam and the selected set point B.

When performed using the method according to the invention, the deflection and/or position control of a deflection compensated doctor blade support beam like one shown in FIG. 2 comprises the steps of:

I. defining a rectangular coordinate system such that the origin of the coordinate system coincides with the center axis of the support tube 4 and both the x-axis and the y-axis of the coordinate system are aligned orthogonal relative to the center axis of the support tube 4;

II. defining control sectors for the range of support beam movements such that the working directions Fa, Fb and Fc of the compensation elements 5*a*, 5*b* and 5*c* essentially define the radial limits between the control sectors. Then, the radial limit vectors of the control sectors are aligned essentially orthogonal relative to the longitudinal axis of the doctor blade support beam;

III. defining a reference point A for the doctor blade support beam such that the reference point substantially coincides with the intersection point of the control sector radial limit vectors (or, of the working direction vectors Fa, Fb and Fc of the compensation elements) with the assumption that the volumes of the compensation elements 5*a*, 5*b* and 5*c* are substantially equal or, alternatively, that the thicknesses of the compensation elements 5*a*, 5*b* and 5*c*, as measured in their respective working directions, are substantially equal;

IV. defining at the instant the doctor blade support beam is desired to be moved on the basis of, e.g., a command received from an automation system, a set point B. whereto the reference point of the support beam is attempted to be driven;

V. determining the control section wherein the set point B is situated and selecting this specific control sector as the active control sector. In the case illustrated in FIG. 2, the active control sector is defined as the acute angle sector delineated by the working direction vectors Fa and Fb; and VI. commanding the control system to drive the reference point A of the doctor blade support beam to the x-coordinate of set point B by adjusting the pressure and/or volume of compensation element 5*b* and, respectively, to the y-coordinate of set point B by adjusting the pressure and/or volume of compensation element 5*a*.

In short, the control strategy is based on knowing the working directions of the compensation elements. According to the method, the position of set point B is continually compared with the measured position of reference point A. Based on this information, it is possible to determine the control sector wherein the coordinates of set point B are located and, thence, which compensation elements must be used in the control of the support beam deflection and position. The control operation is carried out by controlling pressures in the compensation elements 5*a*, 5*b* and 5*c*, whose working directions Fa, Fb and Fc define the radial limit vectors of the control section in question. The control system has separate controllers for both the x- and y-axes so that one compensation element can be used for controlling movements in the x-axis direction while the other compensation element is used for controlling movements in the y-axis direction. However, since each one of the pressure hoses causes a change in both the x- and y-axis directions, the actions resulting from the control operations are made independent from each other by mathematical modeling means. This can be accomplished simply by configuring an interaction decoupling matrix between the control circuits or by controlling the fluid pressures with the help of a multivariate controller, such as a model-based multivariate controller.

Without departing from the scope and spirit of the invention, embodiments different from those described above may also be contemplated.

If the control sector limit vectors (defined by the working directions of the compensation elements) do not converge in a single point, the reference point can be located substantially close to the center point of the area delineated by the sector limit vectors. Then, it is possible to perform control operations within this range by means of conventional control methods, while the method according to the invention is applied outside this range.

The compensation elements can be any kind of deformable elements such as bellows cylinders. The pressurized fluid can be a desired kind of gas, liquid or any at least partially flowable substance such as air, water, oil or grease. The pressurized medium may be heated or cooled, whereby the temperature profile of the doctor blade support beam can be altered so as to enhance the effect of compensation.

The number and location of the compensation elements may be varied. The compensation elements may extend over the entire cross-machine width of the doctor blade support beam or, alternatively, only over a control section of a shorter length. A compensation element extending over the entire cross-machine length of the doctor blade support beam may be comprised of a plurality of adjacent sectors or segments. The number of compensation elements in any cross-sectional plane of the doctor blade support beam may be greater than three as cited in the exemplary embodiment.

The shape of the doctor blade support beam frame 3 and the support tube 4 can be varied in a desired manner. Correspondingly, the stiffening walls 6 and any other structures possibly needed in the interior of the support beam frame 3 can be shaped and dimensioned as necessary. For instance, the stiffening walls 6 may be formed so that the walls provide a lateral support for the compensation elements 5. The cross section of the support tube 4 may be, e.g., triangular or any desired unsymmetrical shape.

The specific details of computation and system modeling can be managed on a case-by-case basis. For instance, the reference point of the doctor blade support beam can be aligned to coincide with the doctor blade mounted in the support beam or any other point of the support beam. The coordinate system can be freely selected among those known in the art, and its origin may be placed in a desired point. If so desired, also the control sectors can be arranged differently from what is taught in the exemplary embodiment.

The actual automation and/or control system may be implemented in a manner and technique different from that used in the exemplary embodiment. The system can also be controlled manually.

Furthermore, the invention may be implemented by using a control sector arrangement, wherein the number of compensation elements is greater than the number of control sectors. This kind of a system may be contemplated when the number of compensation elements is five or more. Herein, it is possible to have one or more compensation elements located between the limits of a given control sector, in addition to those having their working directions coinciding with the control sector limit vectors.

What is claimed is:

1. A method for controlling at least one of a deflection and a position of a doctor blade mounted in a support beam, the doctor blade being used in an apparatus used for coating a web of material, the support beam comprising a plurality of compensation elements mounted in the support beam and being capable of altering at least one of a deflection and a position of the support beam relative to the web, each compensation element being operable in a respective working direction essentially orthogonal to a longitudinal axis of the support beam, the method comprising:

defining a reference point positioned (a) substantially at an intersection of vectors of the respective working direction of each compensation element, or (b) substantially close to the center point of an area delineated by the vectors;

defining a plurality of control sectors radially delineated relative to the longitudinal axis of the support beam by limits of movement of each compensation element and limited circumferentially about the longitudinal axis of the support beam by the respective vectors of the working directions of the compensation elements;

when the support beam is desired to be moved, selecting a set point to which the reference point is to be moved by at least one of deflecting and moving the support beam so that, when the reference point is substantially at the set point, the support beam and the doctor blade mounted therein are in a desired position;

determining an active control sector in which control sector the set point is located;

determining which two compensation elements have vectors of their respective working direction which bound the determined active control sector; and activating the two determined compensation elements to move the reference point so that the reference point moves substantially to the set point, so as to at least one of deflect and move the support beam and the doctor blade mounted therein.

2. The method of claim 1, wherein the support beam comprises:

a box-section triangular frame having a blade holder in which the doctor blade is mounted; and a support tube in the interior of the frame;

wherein the compensation elements extend essentially over an entire cross-machine length of the support beam, the compensation elements having a shape that can be changed by the introduction therein of a pressurized medium, each of the compensation elements being positioned between the support tube and an internal surface of the frame so that each compensation element is backed directly against an exterior surface of the support tube and each compensation element is backed on another side against an interior surface of the frame.

3. The method of claim 2, wherein the pressurized medium is a liquid or gaseous fluid.

4. The method of claim 2, wherein the pressurized medium is oil, water, grease or air.

5. The method of claim 2, further comprising:

defining a coordinate system having two axes orthogonal to the longitudinal axis of the support beam, and wherein activating the first compensation element causes the reference point to move in a direction on the coordinate system substantially along a first coordinate system axis of the two axes, and activating a second compensation element causes the reference point to move substantially along a second coordinate system axis of the two axes.

6. The method of claim 5, wherein the origin of the coordinate system coincides with a center axis of the support tube.

7. The method of claim 6, wherein the first coordinate system axis is perpendicular to the second coordinated system axis.

8. The method of claim 5, wherein the first and second coordinate system axes are essentially orthogonal to the center axis of the support tube.

9. The method of claim 1, further comprising:

defining a coordinate system having two axes orthogonal to the longitudinal axis of the support beam, and wherein activating the first compensation element causes the reference point to move in a direction on the coordinate system substantially along a first coordinate system axis of the two axes, and activating the second compensation element causes the reference point to move substantially along a second coordinate system axis of the two axes.

10. The method of claim 9, wherein the coordinate system axis is perpendicular to the second coordinate system axis.

11. The method of claim 1, wherein activating of the two determined compensation elements is controlled by using mathematical modeling techniques for interaction decoupling between control circuits of the two determined compensation elements.

12. The method of claim 1, wherein a control system at least one of selects the set point and controls activation of the compensation elements.

13. The method of claim 1, wherein the set point is selected based upon information obtained from at least one of measurements, and the control system.

* * * * *